US008910455B2

(12) United States Patent
Yang

(10) Patent No.: US 8,910,455 B2
(45) Date of Patent: Dec. 16, 2014

(54) COMPOSITE I-BEAM MEMBER

(71) Applicant: WeiHong Yang, Sunnyvale, CA (US)

(72) Inventor: WeiHong Yang, Sunnyvale, CA (US)

( * ) Notice: Subject to any disclaimer, the term of this patent is extended or adjusted under 35 U.S.C. 154(b) by 0 days.

(21) Appl. No.: 13/772,338

(22) Filed: Feb. 21, 2013

(65) Prior Publication Data

US 2013/0160398 A1 Jun. 27, 2013

Related U.S. Application Data

(63) Continuation-in-part of application No. 13/225,518, filed on Sep. 5, 2011, now abandoned, which is a continuation of application No. 12/804,601, filed on Mar. 19, 2010, now abandoned.

(51) Int. Cl.
*E04C 3/292* (2006.01)
*E04C 3/46* (2006.01)

(52) U.S. Cl.
CPC . *E04C 3/292* (2013.01); *E04C 3/46* (2013.01); *Y10S 52/06* (2013.01)
USPC ..... 52/841; 52/223.8; 52/745.19; 52/837; 52/842; 52/847; 52/DIG. 6; 29/428; 29/897.3; 29/897.35

(58) Field of Classification Search
CPC ..... E04C 3/26; E04C 3/29; E04C 3/46; E04C 3/291; E04C 3/292; E04C 2003/0452
USPC ..... 52/223.1, 223.4, 223.8, 837, 838, 847, 52/DIG. 6, 841, 842, 745.19; 29/428, 29/897.3, 897.35
See application file for complete search history.

(56) References Cited

U.S. PATENT DOCUMENTS

| | | | | | |
|---|---|---|---|---|---|
| 96,793 | A | * | 11/1869 | Gatling | 52/376 |
| 1,368,594 | A | * | 2/1921 | Aatila | 52/847 |
| 1,453,996 | A | * | 5/1923 | Riddle | 52/376 |
| 1,615,815 | A | | 1/1927 | Birdsey | |
| 2,039,398 | A | | 5/1936 | Dye | |
| 2,099,470 | A | | 11/1937 | Coddington | |

(Continued)

FOREIGN PATENT DOCUMENTS

| | | | |
|---|---|---|---|
| CN | 1840836 | | 10/2006 |
| EP | 115769 | A2 * | 8/1984 |

(Continued)

OTHER PUBLICATIONS

Machine Translation of JP 2007-146617 A retrieval from the JPO on Aug. 20, 2013, 2 pages.

*Primary Examiner* — Basil Katcheves
*Assistant Examiner* — Rodney Mintz
(74) *Attorney, Agent, or Firm* — Law Office of Dorian Cartwright

(57) ABSTRACT

A composite steel I-beam member. The member includes confined top and bottom flanges, and a composite laminated web. The confined flange comprises a wooden core and a metal jacket wrapped around an outer perimeter of the wooden core. The overall load carrying capacity of the composite I-beam is significantly increased through a list of composite actions occurring in the individual components and their connections. Most importantly, a two-way lateral interaction can be normal to the interface between the metal jacket and the wooden core and provide an amount of compressive support to the top flange surpassing the sum of amount of support provided by the metal jacket and the wooden core when being used separately.

16 Claims, 4 Drawing Sheets

(56) References Cited

U.S. PATENT DOCUMENTS 2,125,692 A * 8/1938 Ragsdale et al. ..... 52/839
2,126,622 A 8/1938 Davis
2,167,835 A * 8/1939 Greulich ..... 52/376
2,167,836 A * 8/1939 Greulich ..... 52/376
2,187,280 A * 1/1940 Olson ..... 52/376
2,200,159 A 5/1940 Davis
2,387,432 A * 10/1945 Du Laney ..... 52/376
2,918,150 A 12/1959 Blum
3,294,608 A 12/1966 Peterson
3,349,537 A * 10/1967 Hopfeld ..... 52/842
3,385,015 A 5/1968 Hadley
3,531,901 A * 10/1970 Will, Jr. et al. ..... 52/309.14
3,531,903 A * 10/1970 Swanson ..... 52/841
3,605,360 A 9/1971 Lindal
3,728,837 A 4/1973 Kiefer, Jr.
3,866,884 A 2/1975 Heil et al.
3,913,290 A * 10/1975 Billing et al. ..... 52/347
4,001,993 A 1/1977 Daniels
4,047,354 A * 9/1977 Sutherland ..... 52/840
4,098,109 A 7/1978 Cailloux
4,281,497 A 8/1981 Luotenen et al.
4,335,555 A 6/1982 Southerland et al.
4,430,373 A 2/1984 Hammarberg
4,446,668 A * 5/1984 Christ-Janer ..... 52/836
4,501,102 A 2/1985 Knowles
4,586,550 A 5/1986 Kitipornchai
4,615,163 A 10/1986 Curtis et al.
4,738,071 A 4/1988 Ezard
4,974,387 A 12/1990 Dufour
5,308,675 A * 5/1994 Crane et al. ..... 428/120
5,323,584 A * 6/1994 Scarlett ..... 52/841
5,497,595 A 3/1996 Kalinin
5,503,493 A 4/1996 Kato et al.
5,511,355 A * 4/1996 Dingler ..... 52/842
5,533,309 A 7/1996 Rivin
5,556,565 A * 9/1996 Kirkwood et al. ..... 219/633
5,577,353 A 11/1996 Simpson
5,580,648 A * 12/1996 Castle et al. ..... 442/21
5,617,685 A 4/1997 Meier et al.
5,617,697 A 4/1997 Erwin
5,688,426 A * 11/1997 Kirkwood et al. ..... 219/633
5,713,169 A 2/1998 Meier et al.
5,809,735 A 9/1998 LeBlanc
5,832,691 A 11/1998 Callahan et al.
5,852,908 A * 12/1998 Nankin ..... 52/838
5,875,604 A * 3/1999 Rudd ..... 52/481.1
5,875,605 A * 3/1999 Rudd ..... 52/847
5,899,239 A 5/1999 Coulis
5,974,760 A * 11/1999 Tingley ..... 52/837
6,050,047 A 4/2000 Covelli et al.
6,061,995 A 5/2000 Menchetti et al.
6,105,321 A * 8/2000 KarisAllen et al. ..... 52/223.8
6,134,859 A * 10/2000 Rudd ..... 52/483.1
6,167,675 B1 1/2001 LeBlanc
6,173,550 B1 * 1/2001 Tingley ..... 52/837
6,250,042 B1 * 6/2001 Rudd ..... 52/841
6,260,328 B1 7/2001 Fowler et al.
6,332,301 B1 12/2001 Goldzak
6,343,453 B1 * 2/2002 Wright ..... 52/841
6,412,247 B1 7/2002 Menchetti et al.
6,412,248 B1 * 7/2002 Rudd ..... 52/847
6,457,292 B1 10/2002 Vrana
6,460,310 B1 * 10/2002 Ford et al. ..... 52/837
6,505,454 B2 * 1/2003 Dingler ..... 52/842
6,516,583 B1 2/2003 Houghton
6,516,584 B1 * 2/2003 Rudd ..... 52/846
6,519,911 B1 * 2/2003 Sawada ..... 52/842
6,561,736 B1 * 5/2003 Doleshal ..... 405/251
6,594,964 B2 * 7/2003 Charland ..... 52/302.1
6,715,257 B2 * 4/2004 Kent et al. ..... 52/837
6,729,607 B2 5/2004 Alberson et al.
6,735,919 B1 * 5/2004 diGirolamo et al. ..... 52/838
6,749,709 B1 6/2004 Krishnawswamy et al.
6,886,296 B1 5/2005 John et al.
6,895,723 B2 * 5/2005 Knokey et al. ..... 52/841
6,902,150 B2 6/2005 Alberson et al.
6,938,392 B2 9/2005 Fouad et al.
6,941,718 B1 9/2005 diGirolamo et al.
6,986,205 B2 1/2006 Vrana
6,993,883 B2 2/2006 Belanger
7,168,220 B2 1/2007 Owoc
7,213,379 B2 * 5/2007 Carlson et al. ..... 52/837
7,299,596 B2 11/2007 Hildreth
7,310,920 B2 12/2007 Hovey, Jr.
7,464,512 B1 12/2008 Perina
7,543,369 B2 6/2009 Burkett
7,818,945 B2 * 10/2010 Gregg et al. ..... 52/837
7,882,679 B2 * 2/2011 Carlson et al. ..... 52/834
7,930,866 B2 * 4/2011 Carlson et al. ..... 52/834
8,065,848 B2 * 11/2011 Carlson et al. ..... 52/309.16
8,161,712 B2 4/2012 Mackenzie
8,166,721 B1 * 5/2012 diGirolamo et al. ..... 52/455
8,225,580 B2 * 7/2012 Peneder ..... 52/841
8,266,856 B2 * 9/2012 Carlson et al. ..... 52/309.16
8,322,037 B2 * 12/2012 Carlson et al. ..... 29/897.3
8,329,272 B2 12/2012 Cesternino
8,387,333 B2 * 3/2013 Brekke ..... 52/702
8,438,808 B2 * 5/2013 Carlson et al. ..... 52/309.16
8,468,774 B2 * 6/2013 Garry ..... 52/840
8,511,043 B2 8/2013 Fyfe
8,555,601 B2 * 10/2013 Brunner ..... 52/837
8,621,797 B2 1/2014 Kim et al.
8,650,820 B2 2/2014 Bocquet et al.
2001/0048101 A1 12/2001 Bligh et al.
2002/0024043 A1 2/2002 Albritton
2002/0026762 A1 3/2002 Charland
2002/0073641 A1 6/2002 Menchetti et al.
2002/0088967 A1 7/2002 Lewis et al.
2002/0112428 A1 8/2002 Dingler
2002/0144484 A1 * 10/2002 Vrana ..... 52/729.5
2002/0158241 A1 10/2002 Ochoa
2002/0166306 A1 * 11/2002 Wilson ..... 52/729.1
2003/0194931 A1 10/2003 Crigler
2004/0040253 A1 * 3/2004 Knokey et al. ..... 52/729.4
2004/0226254 A1 11/2004 Charlwood
2004/0226255 A1 * 11/2004 Holloway ..... 52/729.1
2005/0166530 A1 * 8/2005 Wilson ..... 52/720.1
2005/0252165 A1 11/2005 Hubbell et al.
2005/0284078 A1 * 12/2005 Marsland ..... 52/642
2006/0000152 A1 * 1/2006 Davis ..... 52/1
2006/0032182 A1 * 2/2006 Carlson et al. ..... 52/729.1
2006/0070339 A1 * 4/2006 Peneder ..... 52/729.1
2006/0070340 A1 * 4/2006 Fanucci et al. ..... 52/729.1
2006/0156682 A1 * 7/2006 McAndrew et al. ..... 52/729.1
2006/0191235 A1 * 8/2006 Peek et al. ..... 52/729.2
2007/0119108 A1 * 5/2007 Downard ..... 52/289
2007/0131918 A1 6/2007 James
2007/0137137 A1 * 6/2007 Peek et al. ..... 52/729.1
2007/0151198 A1 * 7/2007 Ou ..... 52/729.1
2007/0175126 A1 * 8/2007 Tonyan et al. ..... 52/223.7
2007/0175583 A1 8/2007 Mosallam
2007/0193199 A1 * 8/2007 Carlson et al. ..... 52/729.1
2007/0193212 A1 * 8/2007 Carlson et al. ..... 52/750
2007/0256389 A1 * 11/2007 Davis ..... 52/729.4
2008/0159807 A1 7/2008 Andrews
2008/0178551 A1 7/2008 Porter
2008/0236058 A1 * 10/2008 Antonie ..... 52/90.1
2008/0282633 A1 11/2008 Buckhold
2008/0295453 A1 * 12/2008 Carlson et al. ..... 52/841
2008/0302037 A1 * 12/2008 Brown et al. ..... 52/289
2009/0013640 A1 * 1/2009 Caroussos ..... 52/831
2009/0075031 A1 * 3/2009 Carlson et al. ..... 428/174
2009/0293405 A1 12/2009 Andrews et al.
2010/0018143 A1 * 1/2010 Woerner et al. ..... 52/309.13
2010/0047489 A1 2/2010 Cesternino
2010/0139181 A1 6/2010 Cortina-Cordero et al.
2010/0207087 A1 8/2010 James
2011/0005145 A1 * 1/2011 Contasti ..... 52/98
2011/0056156 A1 * 3/2011 Tonyan et al. ..... 52/232
2011/0113725 A1 * 5/2011 Garry ..... 52/838
2011/0155315 A1 * 6/2011 Von Pinnon ..... 156/257
2011/0167759 A1 7/2011 Cesternino
2011/0179647 A1 * 7/2011 Carlson et al. ..... 29/897
2011/0219726 A1 * 9/2011 Brunner ..... 52/837

(56) References Cited

U.S. PATENT DOCUMENTS

| | | | | |
|---|---|---|---|---|
| 2011/0250417 | A1* | 10/2011 | Hubbell et al. | 428/218 |
| 2011/0252743 | A1* | 10/2011 | Yang | 52/849 |
| 2012/0011805 | A1* | 1/2012 | Yang | 52/834 |
| 2012/0141706 | A1* | 6/2012 | Bocquet et al. | 428/35.6 |
| 2012/0222382 | A1* | 9/2012 | Brekke | 52/702 |
| 2012/0298943 | A1* | 11/2012 | Yang | 256/13.1 |
| 2013/0025222 | A1 | 1/2013 | Mueller | |
| 2013/0055677 | A1* | 3/2013 | Hayden et al. | 52/835 |
| 2013/0133278 | A1* | 5/2013 | Kim et al. | 52/223.4 |
| 2013/0239512 | A1* | 9/2013 | Yang | 52/741.3 |
| 2013/0340384 | A1* | 12/2013 | Hayden et al. | 52/835 |
| 2013/0340385 | A1* | 12/2013 | Hayden et al. | 52/835 |
| 2014/0083046 | A1* | 3/2014 | Yang | 52/704 |
| 2014/0096476 | A1* | 4/2014 | Kim et al. | 52/841 |
| 2014/0182234 | A1* | 7/2014 | Yang | 52/655.1 |
| 2014/0182235 | A9* | 7/2014 | Yang | 52/704 |

FOREIGN PATENT DOCUMENTS

| | | | |
|---|---|---|---|
| EP | 284494 | | 9/1988 |
| FR | 2963819 | A1 * | 2/2012 |
| JP | 11200557 | | 7/1999 |
| JP | 2003343037 | | 12/2003 |
| JP | 2007146617 | | 6/2007 |
| WO | WO 2011115713 | | 9/2011 |

* cited by examiner

COMPOSITE I-BEAM MEMBER

CROSS-REFERENCE TO RELATED APPLICATIONS

This application claims the benefit of priority as a continuation-in-part to U.S. patent application Ser. No. 13/225,518, filed on Sep. 5, 2011, entitled COMPOSITE GUARDRAIL POSTS AND COMPOSITE FLOOR I-JOIST, by WeiHong Yang, and to U.S. patent application Ser. No. 12/804,601, entitled STEEL-WOOD COMPOSITE STRUCTURE WITH METAL JACKET WOOD STUDS AND RODS, by WeiHong Yang, the contents of each being hereby incorporated by reference in its entirety.

FIELD OF THE INVENTION

The present invention relates generally, to construction material, and more specifically, to a composite I-beam member used for construction.

BACKGROUND

I-beams are shaped like the letter "I" to maximize the moment of inertia, which in turn maximizes its resistance to bending and deflection when used as a beam or floor joist. It is well known that I-beams are the most efficient structural members when subjected to bending, and they are widely used in both light-framed and heavy-duty constructions.

In light-framed construction, support for structures is conventionally provided by members composed of a single material, predominantly either wood or metal. These single-material members are often vulnerable to failure due to characteristics of the material. For example, while wood is weak in tension and very vulnerable to fire and termites; a metal stud has inherent problems of pre-mature failure due to weak connection and local buckling. Conventional steel I-beams can be very heavy. Furthermore, use of certain materials can have a negative effect on the environment. For example, inefficient use of timber wastes trees, a valuable natural resource. Also, timber is often treated for use in exterior construction which can add pollutants to the environment. In another example, pressure treated wood produces a large volume of waste water with pollutants.

In heavy duty construction, composite techniques are often used to achieve higher structural performance. A composite structure combines different materials together to form a new structure. Since it fully utilizes the potential of individual materials, the advantages of composite structures have been well recognized in the engineering community during the past decades.

However, past applications, such as concrete-filled steel tubes and composite floor decks, mostly involve combining steel and concrete in various forms, and are primarily used in commercial buildings and infrastructures.

What is needed is to introduce composite techniques in light-framed construction to allow for lighter and stronger I-beam members.

SUMMARY

The above needs are met by an apparatus, system, method and method of manufacture for a composite I-beam member.

In one embodiment, a confined top flange comprises a wooden core and a metal jacket wrapped around an outer perimeter of the wooden core and two inner side walls of an rectangular channel slotted along the longitudinal direction within the wooden core. The metal jacket is pre-stressed to confine the wooden core, providing a two-way lateral interaction. The two-way lateral interaction can be normal to the interface between the metal jacket and the wooden core and, when subjected to compression, provide an amount of support to the top flange surpassing the sum of amount of support provided by the metal jacket and the wooden core when being used separately.

A confined bottom flange comprising substantially a mirror image of the composite top flange. When subjected to tension, the metal jacket alone is capable of providing adequate tensile force to counteract the compressive force of the top flange.

In an embodiment, the composite laminated web comprises a wooden board sandwiched between two light-gauged metal covers. The wooden board provides lateral support to the metal sheet and prevents it from pre-mature lateral buckling, so that the metal sheet can develop the full tensile potential of the metal material, which is so-called one-way lateral interaction. The one-way interaction can also be normal to an interface between the outer metal sheets and the inner wooden board. When subjected to shear force, the shear capacity is mostly provided by the metal sheet, and the wooden board itself provides very little shear capacity if any at all.

A composite laminated web can have a top edge portion inserted into and locked with the confined top flange and a bottom edge portion inserted into and locked with the confined bottom flange using metal connectors. The metal connectors can penetrate an entire width of the composite top and bottom flanges at, for example, the mid-height of inner side walls of the slotted channel. In one embodiment, a localized composite action at the connection between the laminated web and confined flange can increase the capacity of the dowel connection significantly. This composite action is similar to the two-way lateral interaction of the flange, but at a localized region around each metal connector. In this case, the confinement effect is originated from the pre-compression of the metal connector, not the metal jacket. For example, tightening of a nut to a pre-compression when the connector is a bolt.

Advantageously, the composite I-beam member is stronger than wood I-beams, and is also lighter than conventional steel I-beams.

BRIEF DESCRIPTION OF THE FIGURES

In the following drawings like reference numbers are used to refer to like elements. Although the following figures depict various examples of the invention, the invention is not limited to the examples depicted in the figures.

DETAILED DESCRIPTION

An apparatus, system, method, and method of manufacture for a composite I-beam member, are described herein. The following detailed description is intended to provide example implementations to one of ordinary skill in the art, and is not intended to limit the invention to the explicit disclosure, as one of ordinary skill in the art will understand that variations can be substituted that are within the scope of the invention as described.

Figure 1:
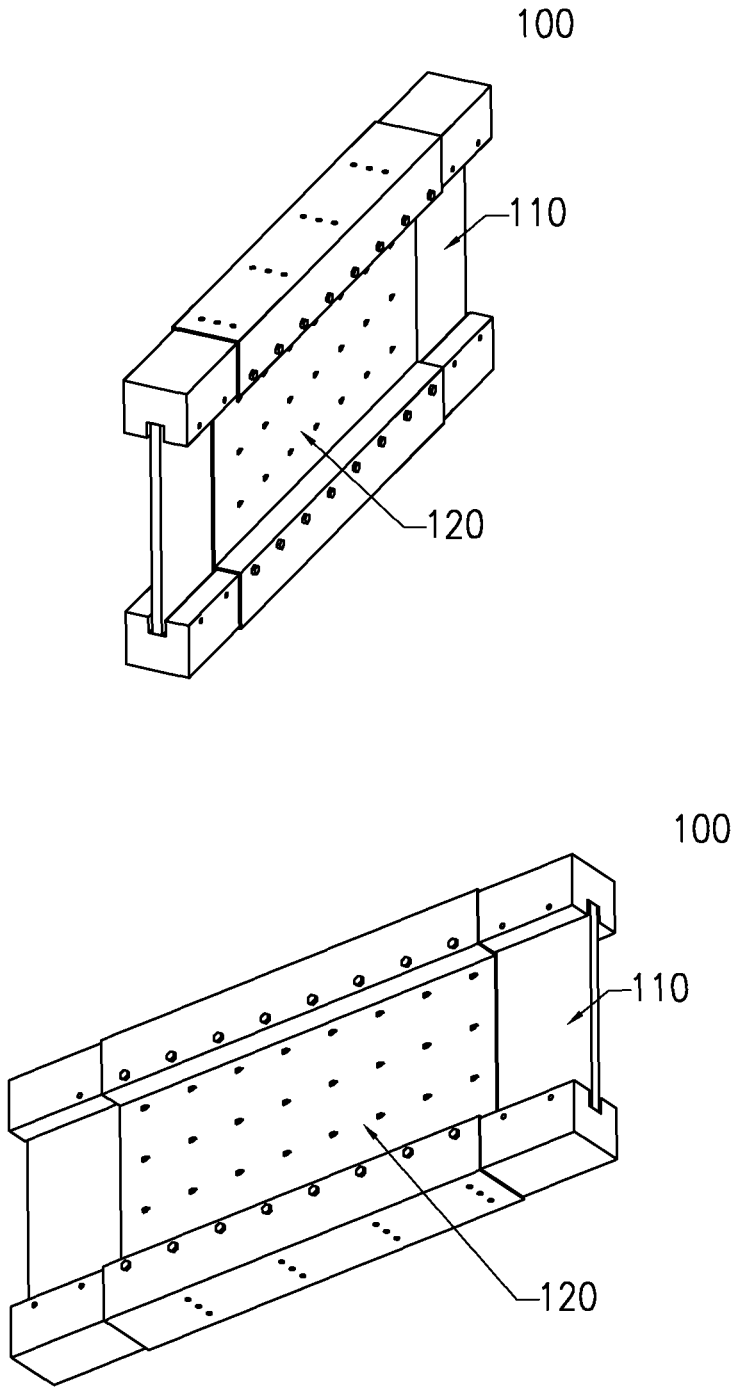
FIG. 1 is a schematic diagram illustrating two different views of a composite I-beam member, according to an embodiment.

FIG. 1 is a schematic diagram illustrating two different views of a composite I-beam member 100, according to an embodiment. The member 100 comprises a wooden core 110 and a metal jacket 120 wrapped around an outer perimeter of the wooden core. The wooden core 110 can be manufactured from an appropriate construction grade lumber, a solid natural wood, an engineered wood or pressed wood. Other materials can be substituted for the wooden core within the spirit of the current invention. The metal jacket 120 can be any type of sheet metal, such as a light-gauged cold-formed steel sheet, an aluminum sheet, a copper sheet, an alloy or any appropriate substitute material.

The member 100 can be a conventional I-beam configuration having a web, a top flange and a bottom flange, as is discussed below with respect to FIG. 2. The dimensions and ratio of the web to flanges can be modified for a particular use (e.g., floor beam versus post). The wooden core 110 can also be shaped as a square, a rectangle, a circle, or any appropriate shape. The member can serve as any type of supporting member, for interior or exterior construction, including a beam, post, or joist, used individually or as part of a combination of members.

The member 100 is configured as a confined top flange and a confined bottom flange coupled to either end of a composite laminated web. In one embodiment, the metal jacket 120A is wrapped around the top core 110A, in a pre-stressed manner, to provide a two-way lateral interaction. The interaction can be normal to an interface between the metal jacket 120A and the wooden core 110A. When the top core is subjected to compression, the two-way lateral interaction generates an amount of support to the top flange that surpasses a sum of an amount of support provided by the metal jacket and the wooden core when being used separately. In other words, the two-way lateral interaction makes the composite top flange stronger than the individual components.

More specifically, the wooden core 110A fails at a certain pressure at which the wood dilates. As the wood dilates, splits within the wooden core 110 open up spaces that span the length or height by opening up spaces within. However, the metal jacket 120A resists the splitting action and maintains integrity in the wooden core 110A beyond the point of individual failure. As a result, the compressive strength and ductility of the top flange is increased.

Similarly, the metal jacket 120A fails at a certain pressure at which the metal buckles. As the metal buckles, rather than opening up spaces as does the wood, the metal folds over itself. In response, the wooden core 110A resists the buckling action and maintains integrity in the metal jacket 120A beyond the point of individual failure. Further, premature local buckling is prevented.

Figure 2:
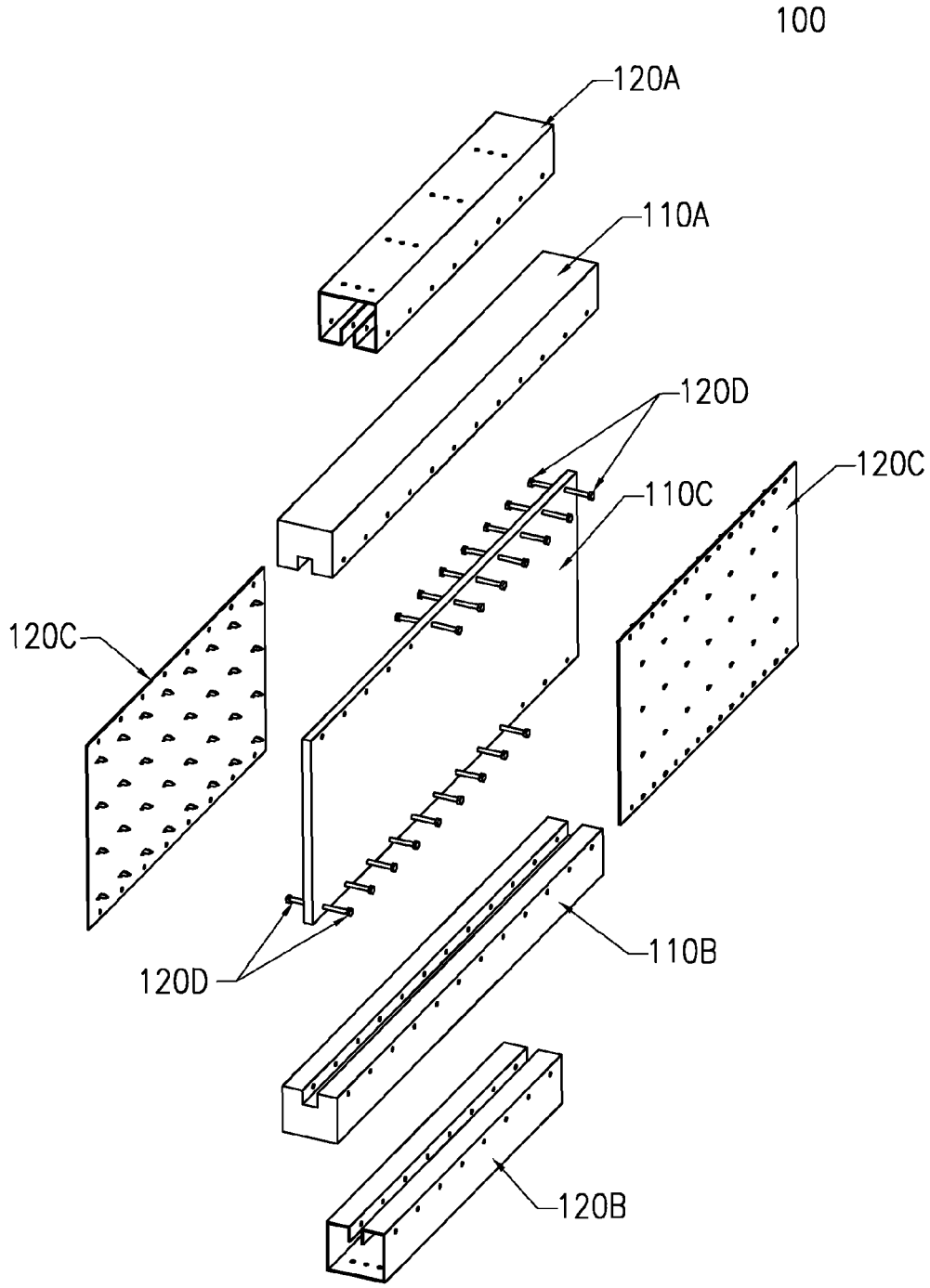
FIG. 2 is a first view of an exploded schematic diagram illustrating a composite I-beam member, according to an embodiment.
Figure 3:
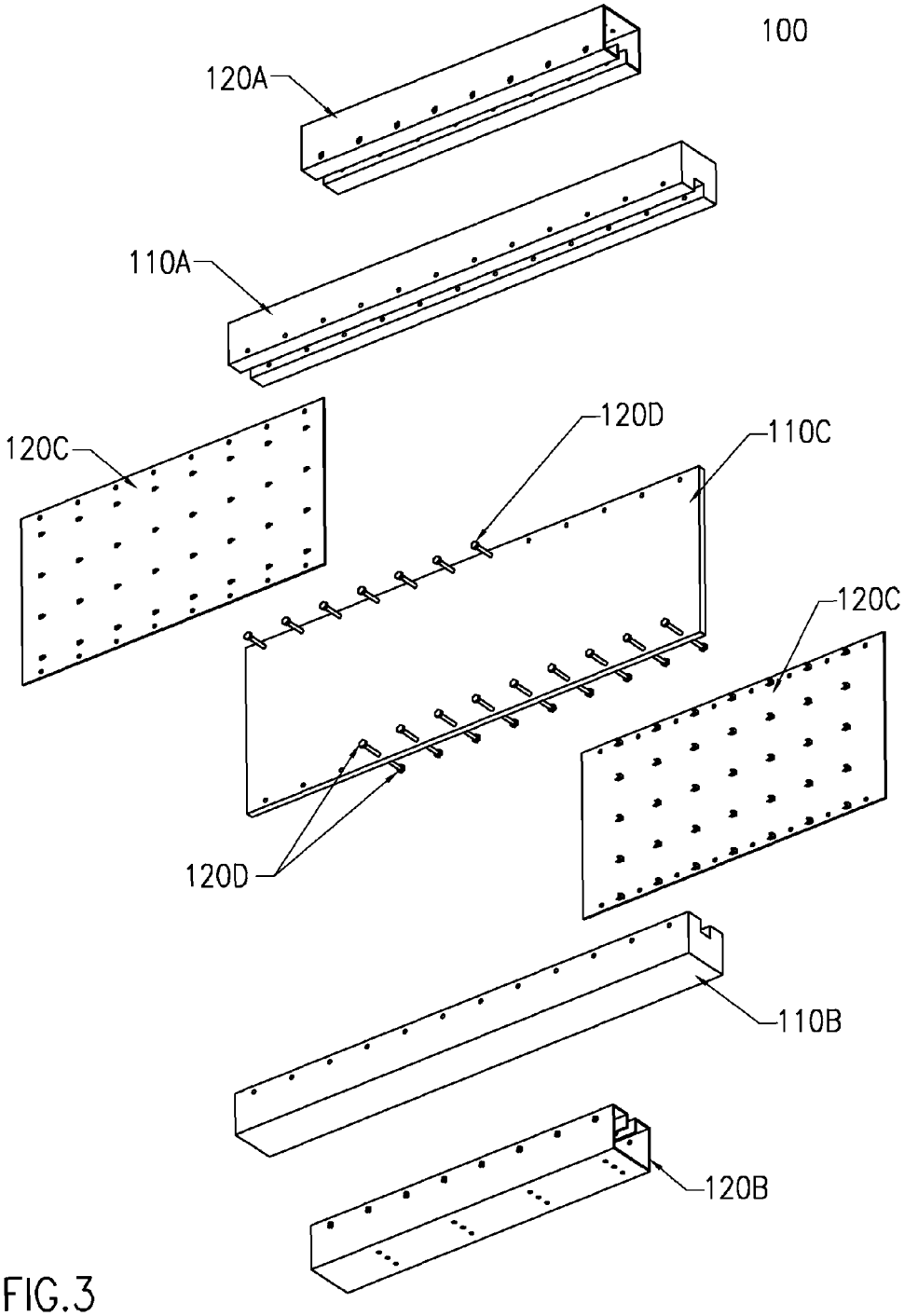
FIG. 3 is a second view of an exploded schematic diagram illustrating a composite I-beam member, according to an embodiment.

FIGS. 2 and 3 are first and second views of an exploded schematic diagram illustrating a composite I-beam member, according to an embodiment. The exploded view highlights individual components of the member 100. The member 100 includes a wooden top flange 110A, a wooden bottom flange 110B and a wooden web 110C. Further, the member 100 includes a metal top flange 120A, a metal bottom flange 120B, and metal web sheets 120C. Also, member includes bolts 120D that can be metal.

Metal jackets are wrapped around wooden cores. For example, the metal top flange 120A is wrapped around the wooden top flange 110A, and the other parts are similarly wrapped. In more detail, the metal top flange 120A wraps around surface portions of the wooden top flange 110A, and in some embodiments, along the inner side walls of a slotted channel spanning a length of the wooden top flange 110A. In some embodiments, the two opposing inner side walls of the slotted channel are wrapped while a third end side remains unwrapped. The metal top flange 120A is wrapped to generate a pre-stress for confinement of the wooden top flange 110A. The bottom flange 120B can be substantially a mirror image of the top flange 120A.

The wooden top and bottom flanges 110A and 110B are both slotted along the length to form a channel in the center of one surface. The width of the slotted channel is slightly wider than the thickness of the wooden web 110C, so as to accommodate the thickness of wooden web 110C plus the edges of four layers of light-gauged metal. When the bottom flange is subjected to tension, there is no meaningful composite action in some embodiments (i.e., no one-way or two-way lateral interaction). The metal jacket 120B alone is capable of providing tensile capacity, and that of the wooden core 110B becomes negligible.

In an embodiment, the composite laminated web comprises a wooden board sandwiched between two light-gauged metal covers. The wooden web 110C provides lateral support to the metal web sheet 120C and prevent it from pre-mature lateral buckling, so that the metal sheet can develop the full tensile potential of the metal material, which is so-called one-way lateral interaction. The one-way interaction can also be normal to an interface between the outer metal sheets and the inner wooden board. When subjected to shear force, the shear capacity is mostly provided by the metal sheet, and the wooden board itself provide very little shear capacity if any at all.

The composite laminated web only accounts for shear force support. In one embodiment, the wooden web 110C is sandwiched by the metal web sheets 120C, and provide a one-way lateral interaction. The interaction can be normal to an interface between the metal sheet 120C and the wooden web 110C. More specifically, the wooden web 110C provides lateral support to the metal sheet and prevent it from premature lateral buckling, so that the metal sheet can develop the full tensile potential of the metal material. The shear capacity is mostly provided by the metal sheet, and the wooden web 110C primarily help to increase the shear capacity of the metal sheets, but the wooden web 110C itself provides very little shear capacity if any at all. In another embodiment, the composite action of the laminated web can increase the capacity of the dowel connection 120D significantly. The presence of wooden web 110C can prevent pre-mature tear-off failure of the metal sheets, and the confinement effect of metal sheets that sandwich the wooden web 110C can significantly increase local bearing capacity of wooden web 110C, so that a much higher shear force can be reliably transferred between the web and flange through the connectors 120D.

In one embodiment, localized composite action at the connection between the laminated web and confined flange can increase the connection capacity significantly. This composite action is similar to the two-way lateral interaction of the flange, but at a localized region around each metal connector. In this case, the confinement effect is originated from the pre-compression of the metal connector, not the metal jacket. For example, tightening of a nut to a pre-compression when the connector is a bolt.

Bolts 120D can be used not only to hold the wrapping, but also to connect the top and bottom flanges to the web. The bolts can comprise a steel through-bolt, a rivet, a screw, a nail, or any other appropriate connector. As shown, one configuration of bolts 120D run in substantially equal increments from one end of the web to the other along both edges. An individual bolt 120D penetrates an entire width of the flanges. More particularly, the bolt 120D penetrates the wooden top flange 110A and the wooden web 110C as well as six layers of metal jackets including: two metal jackets on the outer surfaces of the wooden top flange 110A (i.e., 120A), two metal jackets on the inner side walls of the slotted channel (i.e., 120A) and two metal jackets on outer surfaces of the web (i.e., 120C). The metal jackets 120, in some embodiments, include pre-drilled holes corresponding to pre-configured placement of bolts 120D.

The metal jackets 120C for the web can further include a pattern of pre-punched teeth. Any pattern variation of teeth are possible. As shown, the teeth are evenly spaced horizontally and vertically in a crisscross pattern. The teeth bind to the wood.

Figure 4:
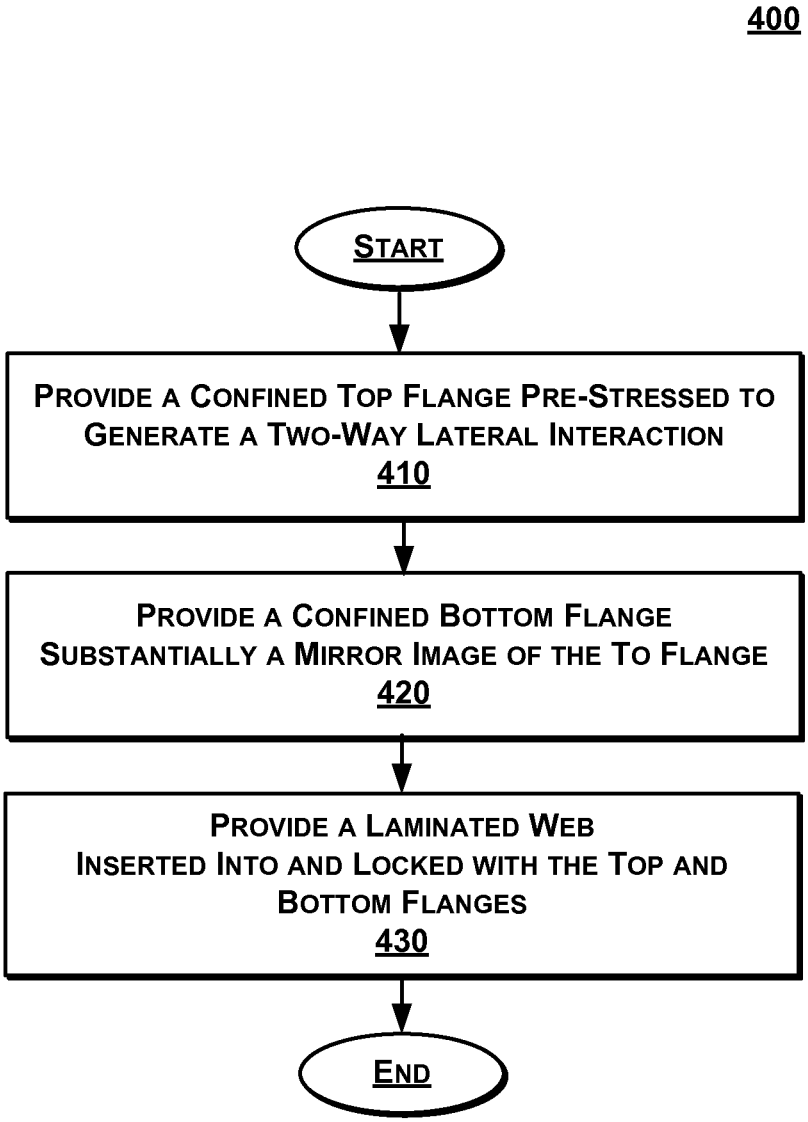
FIG. 4 is a block diagram illustrating a method for producing a composite I-beam to provide support to a structure.

FIG. 4 is a block diagram illustrating a method 400 for producing a composite I-beam to provide support to a structure.

At step 410, a confined top flange is provided. The confined top flange can comprise a metal jacket wrapped around an outer perimeter of a wooden core, and along the two inner side walls of a rectangular channel slotted along the wooden core. The metal jacket can be pre-stressed to confine the wooden core. The pre-stress generates a two-way lateral interactions that, in some embodiments, is normal to an interface between the metal jacket and the wooden core. The two-way later interaction allows the member to provide an amount of support surpassing a sum of amount of support provided by the metal jacket and the wooden core when being used separately.

At step 420, a confined bottom flange is provided. In an embodiment, the confined bottom flange is substantially a mirror image of the confined top flange.

At step 430, a laminated web is provided. The laminated web can have a top edge portion inserted into the slotted channel within the confined top flange and a bottom edge portion inserted into the slotted channel within the confined bottom flange. Then, the laminated web is locked to both top and bottom flanges using metal connectors. The connectors can penetrate an entire width of the top and bottom flanges in the middle-depth of the slotted channel along the length of the member.

In summary, the overall load carrying capacity of the composite I-beam is significantly increased through a list of composite actions occurring in the individual components and their connections. Specifically, (1) the compression capacity of the flanges is increased through the two-way lateral interaction; (2) the tension capacity of the flanges is increased because metal has very high tensile capacity by nature; (3) shear capacity of the web is increased through the one-way lateral interaction; and (4) the shear capacity of the connection is also increased through localized composite action similar to the two-way lateral interaction. The end result is a light weight composite I-beam that has very high strength and ductility.

The disclosure herein is intended to be illustrative, but not limiting, of the scope of the invention, which is set forth in the following claims.

The invention claimed is:

1. A composite I-beam member to provide support to a structure, comprising:

a confined top flange comprising a wooden core and a metal jacket wrapped around an outer perimeter of the wooden core and two opposing inner side walls of a rectangular channel slotted within the wooden core, wherein the metal jacket is pre-stressed to confine the wooden core, providing a two-way lateral interaction normal to an interface between the metal jacket and the wooden core and, when subjected to compression, providing an amount of support to the top flange surpassing the sum of amount of support provided by the metal jacket and the wooden core when being used separately;

a confined bottom flange comprising substantially a mirror image of the confined top flange; and a composite laminated web, having a top edge portion inserted into and locked with the confined top flange and a bottom edge portion inserted into and locked with the confined bottom flange using metal connectors that penetrate an entire width of the confined top and bottom flanges through the two inner side walls of the rectangular channel, wherein the composite laminated web comprises: a wooden web sandwiched between two pieces of light-gauged metal covers, the metal covers being bonded to the wooden web and being laterally supported by the wooden web which provides a one-way lateral interaction normal to an interface between the metal covers and the wooden web, and when subjected to shear forces, providing an amount of support to the structure surpassing the amount of support provided by the metal covers when being used without the wooden web, wherein the metal covers each comprise a plurality of teeth that bind a metal sheet to the wooden web, wherein the metal connectors penetrate the two inner side walls of the rectangular channel and six-layers of metal jackets including both metal jackets of outer side walls of a composite flange perimeter, both metal jackets of the inner side walls of the rectangular channel of the top or bottom flange, and both metal jackets of long sides of a perimeter portion of the composite laminated web engaged within the slotted rectangular channel of the top or bottom flange.

2. The composite I-beam member of claim 1, wherein the metal connectors are selected from the group consisting of: steel through-bolt, rivet, screw, and nail.

3. The composite I-beam member of claim 1, wherein the metal jacket and wooden cores of the confined top and bottom flanges comprise a plurality of pre-drilled holes corresponding to pre-configured placement of the metal connectors.

4. The composite I-beam member of claim 1, wherein a plurality of connectors span along a length of the confined top and bottom flanges.

5. The composite I-beam member of claim 1, wherein the wooden core of the confined top and bottom flanges is selected from the group consisting of: a solid nature wood, and an engineered wood.

6. The composite I-beam member of claim 1, wherein the metal jacket of the confined top and bottom flanges is selected from the group consisting of: a light-gauged cold-formed steel sheet, a stainless steel sheet, an aluminum sheet, a copper sheet, and an alloy sheet.

7. The composite I-beam member of claim 1, wherein a shape of a cross-section of the wooden core of the confined top and bottom flanges is one of selected from the group consisting of: a square, a rectangle, and a circle.

8. The composite I-beam member of claim 1, wherein the metal jacket of the confined top and bottom flanges comprises a pattern of pre-punched teeth used to attach the metal jacket to the wooden core.

9. The composite I-beam member of claim 1, wherein the metal jacket of the confined top and bottom flanges provide lateral confinement for the wooden core to increase compressive strength and ductility of the wooden core.

10. The composite I-beam member of claim 1, wherein the wooden core of the confined top and bottom flanges provides lateral support for the metal jacket to prevent pre-mature local buckling failure of the metal jacket.

11. The composite I-beam member of claim 1, wherein additional amount of support is achieved through the interaction between the wooden core of the confined top and bottom flanges and metal jacket to enhance the compressive strength and ductility of the composite I-beam member to a level that is substantially higher than the sum of the wooden core and the metal jacket when used alone.

12. The composite I-beam member of claim 1, wherein the wooden web of the composite laminated web is composed of at least one of: plywood board, oriented strand board (OSB board), and particle board made of waste-wood.

13. The composite I-beam member of claim 1, wherein the metal cover of the composite laminated web is composed of at least one of: a light-gauged cold-formed steel sheet, a stainless steel sheet, an aluminum sheet, a copper sheet, and an alloy sheet.

14. The composite I-beam member of claim 1, wherein the metal covers and wooden web of the composite laminated web comprise a plurality of pre-drilled holes corresponding to pre-configured placement of the metal connectors.

15. A composite I-beam member to provide support to a structure, comprising:

a confined top flange comprising a wooden core and a metal jacket wrapped around an outer perimeter of the wooden core and two opposing inner side walls of a rectangular channel slotted within the wooden core, wherein the metal jacket is pre-stressed to confine the wooden core, providing a two-way lateral interaction normal to an interface between the metal jacket and the wooden core and, when subjected to compression, providing an amount of support to the top flange surpassing the sum of amount of support provided by the metal jacket and the wooden core when being used separately;

a confined bottom flange comprising substantially a mirror image of the confined top flange, wherein the metal jacket of the confined top and bottom flanges comprises a pattern of pre-punched teeth used to attach the metal jacket to the wooden core; and a composite laminated web, having a top edge portion inserted into and locked with the confined top flange and a bottom edge portion inserted into and locked with the confined bottom flange using metal connectors that penetrate an entire width of the confined top and bottom flanges through the two inner side walls of the rectangular channel, wherein the composite laminated web comprises: a wooden web sandwiched between two pieces of light-gauged metal covers, the metal covers being bonded to the wooden web and being laterally supported by the wooden web which provides a one-way lateral interaction normal to an interface between the metal covers and the wooden web, and when subjected to shear forces, providing an amount of support to the structure surpassing the amount of support provided by the metal covers when being used without the wooden web, wherein the metal covers each comprise a plurality of teeth that bind a metal sheet to the wooden web, wherein the metal connectors penetrate the two inner side walls of the rectangular channel and six-layers of metal jackets including both metal jackets of outer side walls of a composite flange perimeter, both metal jackets of the inner side walls of the rectangular channel of the top or bottom flange, and both metal jackets of long sides of a perimeter portion of the composite laminated web engaged within the slotted rectangular channel of the top or bottom flange.

16. A method of providing support to a structure using a composite I-beam member, the method comprising the steps of:

providing a confined top flange comprising a wooden core and a metal jacket wrapped around an outer perimeter of the wooden core and two opposing inner side walls of a rectangular channel slotted within the wooden core, wherein the metal jacket is pre-stressed to confine the wooden core, providing a two-way lateral interaction normal to an interface between the metal jacket and the wooden core and, when subjected to compression, providing an amount of support to the top flange surpassing the sum of amount of support provided by the metal jacket and the wooden core when being used separately;

providing a confined bottom flange comprising substantially a mirror image of the confined top flange; and providing a composite laminated web, having a top edge portion inserted into and locked with the confined top flange and a bottom edge portion inserted into and locked with the confined bottom flange using metal connectors that penetrate an entire width of the confined top and bottom flanges through the two inner side walls of the rectangular channel, wherein the composite laminated web comprises: a wooden web sandwiched between two pieces of light-gauged metal covers, the metal covers being bonded to the wooden web and being laterally supported by the wooden web which provides a one-way lateral interaction normal to an interface between the metal covers and the wooden web, and when subjected to shear forces, providing an amount of support to the structure surpassing the amount of support provided by the metal covers when being used without the wooden web, wherein the metal covers each comprise a plurality of teeth that bind a metal sheet to the wooden web, wherein the metal connectors penetrate the two inner side walls of the rectangular channel and six-layers of metal jackets including both metal jackets of outer side walls of a composite flange perimeter, both metal jackets of the inner side walls of the rectangular channel of the top or bottom flange, and both metal jackets of long sides of a perimeter portion of the composite laminated web engaged within the slotted rectangular channel of the top or bottom flange.

* * * * *